US006379427B1

(12) United States Patent
Siess

(10) Patent No.: US 6,379,427 B1
(45) Date of Patent: Apr. 30, 2002

(54) METHOD FOR PROTECTING EXPOSED SURFACES

(76) Inventor: Harold E. Siess, 8629 Welbeck Way, Gaithersburg, MD (US) 20879

( * ) Notice: Subject to any disclaimer, the term of this patent is extended or adjusted under 35 U.S.C. 154(b) by 0 days.

(21) Appl. No.: 09/455,164

(22) Filed: Dec. 6, 1999

(51) Int. Cl.[7] ..... B03C 3/017

(52) U.S. Cl. ..... 95/57; 55/385.2; 95/58; 95/78; 96/16; 96/224; 361/226

(58) Field of Search ..... 96/27, 97, 16, 96/224; 95/58, 61, 57, 78; 55/385.2, 385.1, 385.7; 239/3, 706; 361/231–233, 226

(56) References Cited

U.S. PATENT DOCUMENTS 3,537,447 A * 11/1970 Gauthier et al. ..... 128/847
3,673,463 A * 6/1972 Gourdine ..... 96/27 X
3,681,896 A * 8/1972 Velkoff ..... 96/27
3,757,491 A * 9/1973 Gourdine ..... 96/27
3,802,625 A * 4/1974 Buser et al. ..... 96/27 X
3,958,959 A * 5/1976 Cohen et al. ..... 96/27 X
3,960,505 A * 6/1976 Marks ..... 96/27 X
4,140,105 A * 2/1979 Duvlis ..... 422/120 X
4,162,144 A * 7/1979 Cheney ..... 96/27 X
4,366,525 A * 12/1982 Baumgartner ..... 361/231
4,471,688 A * 9/1984 Smets ..... 55/DIG. 29
4,475,927 A * 10/1984 Loos ..... 96/27 X
4,562,510 A * 12/1985 Forry et al. ..... 361/226 X
4,650,171 A * 3/1987 Howorth ..... 128/845 X
4,672,504 A * 6/1987 Stone ..... 361/231
4,684,063 A * 8/1987 Goudy, Jr. ..... 96/27 X
4,802,470 A * 2/1989 Hara et al. ..... 601/15
4,854,500 A * 8/1989 Mathai et al. ..... 239/3
4,911,737 A * 3/1990 Yehl et al. ..... 361/231 X
5,055,963 A * 10/1991 Partridge ..... 361/231
5,141,529 A * 8/1992 Oakley et al. ..... 55/385.2 X
5,215,539 A * 6/1993 Schoolman ..... 604/541
5,218,973 A * 6/1993 Weaver et al. ..... 607/152
5,468,488 A * 11/1995 Wahl ..... 128/205.27 X
5,492,551 A * 2/1996 Wolfe ..... 55/496
5,863,312 A * 1/1999 Wolfe ..... 55/495
5,879,435 A * 3/1999 Satyapal et al. ..... 96/224 X
5,906,638 A * 5/1999 Shimoda ..... 607/152
6,118,645 A * 9/2000 Partridge ..... 361/231
6,126,722 A * 10/2000 Mitchell et al. ..... 96/97 X

* cited by examiner

*Primary Examiner*—Richard L. Chiesa

(57) ABSTRACT

A method for protecting an exposed surface in an enclosed space, such as a building, medical room, manufacturing space or consultation room, from harmful airborne agents. Airborne agents are charged by exposure to an electrostatically-charged cloud and an electrostatically-charged field is created for electrostatically manipulating the harmful airborne agent away from or toward the exposed surface for protecting the exposed surface from the harmful airborne agent. The harmful airborne agent may be collected on a charged surface, and destroyed by ultraviolet light.

16 Claims, 10 Drawing Sheets

METHOD FOR PROTECTING EXPOSED SURFACES

BACKGROUND OF THE INVENTION

Attempts to protect the human body or surfaces contacted by the human body from various airborne contaminants have taken many forms. Considerable use has been made of air purifiers to remove macroscopic contaminants. For this purpose, air ventilation systems in enclosed areas such as buildings generally include an air filter and/or an electrostatic precipitator. However, it is well known in the art, that while the quantity of contaminants that reach the space to be protected can be reduced by such means it is not possible to completely preclude the entry of small airborne contaminants having a diameter less than 10 $\mu$m, such as bacteria, viruses and the like. As a consequence of ineffective air purification, harmful airborne agents are disseminated throughout the enclosed area and come into contact with exposed surfaces.

In order to overcome the problems associated with small airborne contaminants, filters have been developed with micron sized pore openings. However, due to the small nature of the pore openings these filters became clogged in a short period of time. In order to overcome this problem, an electrostatic charge has been applied to the surface of such filters for repelling particles rather than entraining them in the filtering medium. As an example, U.S. Pat. No. 5,863,312 describes a face mask for covering a wearer's mouth, nose or both, with a single layer of non-entraining filter medium which may have an electrostatic charge applied to it for rejecting particulate matter rather than catching or entraining it. In addition, U.S. Pat. No. 5,492,551 describes a similar means for filtering air by electrostatic rejection.

U.S. Pat. Nos. 5,863,312 and 5,492,551 do not describe a method and apparatus for imparting some or substantially all of the airborne agents with a repellent charge. In the operation of the method and apparatus of these inventions, the air to be purified contained substantial amounts of: (1) uncharged airborne agents; (2) airborne agents with a repellent charge; and (3) airborne agents having an attracting charge with respect to the filter or mask. As such, not all of the airborne agents can be repelled away from the filter or mask. Therefore, the pore size of the filter medium was made to be smaller then the airborne agents for collecting them. In addition, in the use of the method and apparatus of these inventions, naturally occurring oppositely charged particles contained in the particulate laden air are attracted to and also accumulate on the electrostatically charged filter medium. The accumulation of both the neutral and charged particulate matter both clogs the pores of the filter and reduces the efficiency of repulsion by reducing or screening the electrostatic charge on the filter.

Another filtering system that used both rejection and collection of charged agents on a filter is given in U.S. Pat. No. 5,468,488. This patent describes a method and apparatus for restricting the flow of airborne contaminants into a nasal passage. In the operation of the method of U.S. Pat. No. 5,468,488 a spray solution is sprayed onto or around the nasal passages for providing for an electrostatic field. As with the two previously mentioned patents, it involves creating an electrostatic field that either repels or attracts airborne contaminants or both but does not provide for a method and apparatus for electrifying airborne agents with a repellant charge.

Other methods used in the past to shield humans from airborne contaminants have included the use of gas curtains and physical barriers such as surgical garments and masks. An example of the use of air curtains as protective shields is given in U.S. Pat. Nos. 4,140,105 and 4,471,688.

Currently, surgical garments and masks are used as the primary protection for operating room personnel. Surgical garments and masks are not intended to, and do not prevent, the spread of harmful substances and biogenic materials to all parts of the general operating room environment and do not protect certain parts of the practitioner. For example, such equipment often does not protect the eyes and other exposed parts of the body of operating room personnel from contact with fluids in the form of airborne aerosols including bone particles and liquids from direct sprays, streams, or splashes of liquids. Surgical garments that completely cover the body such as those that resemble astronaut's space suit protect only the person wearing it and provide no protection to others in the room against airborne agents. The production of such airborne agents in medical facilities can cause contaminants to come into contact with the mucus membranes of the medical staff. Airborne agents of this type can contain live virus, including AIDS virus, when such is present in the patient. Accidental contamination with airborne aerosols of blood and body fluids of patients having other diseases, such as hepatitis B, may also be communicated by such a mechanism.

When using surgical equipment, the operator often must be able to move in many directions to get the correct point of contact or leverage to use the equipment. Conventional barriers, whether physical or air curtain often limit visibility and/or mobility and/or expose the operator to airborne contaminants. In particular, when using surgical and dental equipment, a medical practitioner must often work between the vacuum source or physical barrier and the operating site, thus exposing the practitioner to infection.

Non-shielding methods used in the past to protect humans from airborne contaminants have included the use of vacuums as described in U.S. Pat. Nos. 3,537,447 4,650,171 and 5,215,539.

Vacuum devices positioned on the instrument itself typically limit the area of protection, as the vacuum only draws in air from the area nearest to the tool. Finally, vacuum devices currently in use and having self-contained vacuum source are often limited in application, as such devices incorporate no means for the containment, destruction, or safe evacuation of contaminants. Such devices are inappropriate for protection from hepatitis and AIDS, as those viruses are dangerous in low concentrations and could be carried to remoter sites by an evacuation system that does not remove contaminants from the gas stream.

In many medical situations open wounds, ulcers, and burned tissue are exposed to airborne agents. As such, wounds and skin ulcers can become contaminated by airborne microorganisms, both pathogenic and non-pathogenic types. Wounds that are heavily contaminated by microorganisms, but not clinically infected, are often characterized by a prolonged period of inflammation as well as a delay in wound repair and healing.

Present shielding systems and other methods for protecting humans from airborne contaminants are inadequate for removing all of the pathogen carrying aerosols produced in a medical procedure. Current air purifiers do not remove bacteria and viruses and provide no protection at all against airborne contaminants in spaces where airborne contaminants are produced, such as medical and dental consultation rooms, operating rooms and the like.

OBJECTS OF THE INVENTION

It is an object of the present invention to provide for a method and apparatus for protecting an exposed surface contained in an enclosed space from harmful airborne agents that may be unintentionally produced.

It is another object of the present invention to provide for a method and apparatus for maintaining a repellant charge on an exposed surface for repelling oppositely charged particles.

It is still another object of the present invention to provide for a method and apparatus for collecting and destroying harmful airborne agents.

It is a further object of the present invention to provide for a method and apparatus for confining potentially harmful airborne agents to the smallest area possible and thus, minimize its dissemination and ultimate spread to other areas or to humans.

It is a still further object of the present invention to provide an improved method of and apparatus for shielding a patient or a medical practitioner from pathogen carrying aerosols produced by a patient during a medical operation.

It is also an object of the present invention to provide for a method and apparatus for protecting an exposed surface from airborne agents which can be done solely by electrostatic means and apart from any other known method of protecting an exposed surface such as by filtering, physical barriers, air curtains and vacuum systems and without the need for the movement of air by such devices as pumps, fans and the like.

In addition, it is an object of the present invention to provide for a method and apparatus for filtering harmful airborne agents from a gas such as air by subjecting the airborne agents to a charging means for charging the agents with a charge of single polarity and charging a filter, which may have pore openings larger than the agents the be filtered, with a like charge for filtering a flow of air.

SUMMARY

Definitions

As used herein the word "wound" is intended to include: surgical incisions, abrasions, cuts, punctures, blemishes, tears, sores, blisters, burns, contusions, tissue ruptures and the like. As used herein the words "exposed surfaces" are surfaces that are either part of the human body or are surfaces that come into intimate contact with the human body during normal use and as such transmit, pass or otherwise act as a source for toxic, harmful or infectious airborne agents to humans.

As used herein, the words "biogenic particles" are particles of biological origin. They include viable entities such as bacteria, fungi, viruses, amoebae, algae, and pollen grains and the no-longer-viable forms of the same. The also include plant parts; insect parts and wastes; animal saliva, urine, and dander; human dander; and a variety of organic dusts. As used herein the word "shield" means to deflect a moving airborne particle from its original path as a shield deflects an arrow.

This invention relates to the protecting of exposed surfaces that can transmit, pass or otherwise act as a source of toxic or infectious airborne agents to humans such that humans become infected or contaminated by the airborne substance. In particular, this invention relates to the protecting of exposed surfaces from noxious airborne agents such as, but not limited to, (1) industrial particulates, (2) infectious matter such as bacteria, viruses, fungal spores, and aerosols that may carry these infectious agents, (3) potential disease carrying aerosols produced from blood and other bodily fluids, small particles of skin, fat, muscle tissue and bone, (4) particles which may be emitted from a human body such as respiratory droplets, skin squamae, and hair, (5) allergenic materials such as pollen, spores, and animal dander, (6) caustic agents such as airborne acids and bases and (7) aerosols used as chemical or biological warfare agents. More particularly, this invention relates to the protecting of exposed surfaces from toxic and/or infectious airborne agents where the protecting of such surfaces for health and safety reasons is desirable and an unobstructed manual access is necessary.

The present invention is useful for controlling the spread of *E. Coli,* salmonella and other pathogens from the surfaces of foods by airborne agents. In particular, the present invention is useful for protecting exposed surfaces such as meat and meat products and surfaces that come into contact with the same from pathogen carrying airborne particles produced in slaughter houses and the like.

The present invention is also useful for protecting exposed animate surfaces such a humans or part thereof such as, but not limited to, skin, lungs, eyes, mucus membranes and wounds from harmful airborne agents. In particular, this invention is useful for protecting the exposed surfaces of patients and medical staff from noxious airborne agents. More particularly, this invention is useful for the protecting of patients with reduced immune responses from such conditions as AIDS or have an increased risk of infection due to such conditions as illness, wounds or surgical wounds. In addition, the present invention is useful for protecting exposed inanimate surfaces, such as polymeric materials, glass, rubber, metal, food and drugs, that come into intimate contact with humans such that they can transmit, pass or otherwise act as a source of toxic or infectious airborne agents to humans. In particular, the present invention is useful for protecting inanimate surfaces such as, but not limited to, medical equipment, food, food handling equipment, drugs and drug handling equipment.

Furthermore, the present invention is useful for protecting exposed surfaces from harmful airborne agents produced unintentionally by or during human activity. In particular, the present invention is useful for protecting exposed surface from harmful airborne agents produced by or during the following activities: (1) the operation of medical tools such as high speed drills, saws, reamers, and cutting equipment and other tissue removing implements, (2) the release of contaminants from various medical procedures such as the insertion or withdrawal of tubes and other medical procedures wherein an instrument is brought into physical contact with bodily fluids; (3) the release of contaminants as by suctioning or by irrigation; and (4) the release of emitted particles such as respiratory droplets and skin squamae from infected patients during breathing or movement of the body.

The present invention is applicable to the protecting of exposed surfaces from airborne agents in reduced spaces as found in buildings. In particular, the present invention is applicable to the protecting of exposed surfaces from airborne agents in buildings such as hospitals, medical and dental consultation rooms, laboratories, drug manufacturing plants, food production facilities and the like. In addition, the present invention is applicable to the protecting of exposed surfaces from airborne agents in reduced spaces as found in vehicles. In particular, the present invention is applicable to the protecting of exposed surfaces from airborne agents in vehicles such as ground craft, aircraft, spacecraft, marine craft and the like.

The present invention provides for a method and apparatus for protecting an exposed surface from harmful airborne agents, comprising the steps of: subjecting the airborne agents to a charging means for placing one particular charge type, which can be either positive or negative, on the agents; and placing an electrostatic charge on or near the exposed surface for moving, by a repellant or attracting force, the charged airborne agents from the exposed surface for protecting the surface.

The present invention also provides for a self-contained, portable and prefabricated apparatus adapted to be assembled within the confines of a preexisting structure or room, such as a hospital room, operating room, or medical or dental consultation room for confining, collecting and destroying airborne pathogens. The apparatus comprises: a charging means for forming charged species; a moving means for moving the charged species through an area where pathogen containing airborne agents are being produced for bringing the charged species into intimate contact with the airborne agents for combining with, transferring their charge to, or otherwise electrifying the airborne agents; a collection means for collecting charged airborne agents; and a pathogen destruction device for destroying the collected airborne pathogens. A barrier can be placed around the worldling area for further restricting the airborne agents. The barrier can be charged for repelling charged airborne agents. An insulated floor can be provided for insulating objects or persons inside the apparatus.

The present invention provides for a method and apparatus for electrostatically charging aerosols produced by a medical tool such as a drill, saw, reamer and other aerosol producing tools. The aerosol ionizer is useful for charging aerosols produced by medical tools, in particular, electric medical tools such as drill, saws, reamers and other tissue removing devices for their subsequent collection and destruction.

In addition, the present invention provides for a method and apparatus for electrifying an exposed individual, such as a patient or medical staff member, from repelling harmful airborne agents. The method comprises the following step: (1) an individual to be electrified is placed in an airtight booth; (2) the individual is sprayed with a charged matter of single polarity, such as an aerosol, droplets and the like for charging the individual with a single polarity; (3) the individual exits the booth and enters into a room of higher pressure containing charged airborne agents having the same polarity.

Furthermore, the present invention provides for a method and apparatus for electrifying an exposed surface for repelling charged airborne agents comprising; a power supply for applying a voltage of between 0 and 50,000 volts to an object for protecting the exposed surface and with a current of between 1 and 5 micro amperes.

The advantages of the present invention in shielding exposed surfaces over prior art include:

1. Can protect exposed surfaces from small airborne agents having a diameter less than 10 $\mu$m.
2. Can repel substantially all airborne contaminates from a mask for improving the efficiency, the operational life, of the mask and for increasing the size of the pores for easier breathing and reduced manufacturing costs.
3. Can protect the eyes, mucous membranes, wounds and other exposed surfaces of medical staff and patients without the need for spacesuit style clothing.
4. Can confine medically produced aerosols to confined areas to minimize its dissemination and ultimate spread to other areas or humans.
5. Can provide for the containment, destruction, and safe evacuation of airborne contaminants.
7. Can provide for safe medical and dental care to patients without treating the patient as some type of disease carrier.
8. A practitioner is allowed full freedom of movement relative to holding and moving tools, as the electrostatic fields operate as such that the practitioner does not have to work under or around a physical shield. Also, visibility of the operating site is maintained due to the transparent nature of electrostatic fields.
9. Allows for the passage of air over a wound for exposing the wound to an oxygen rich environment for increasing the rate of healing, while repelling infectious airborne agents.

DETAILED DESCRIPTION OF THE INVENTION

Figure 1:
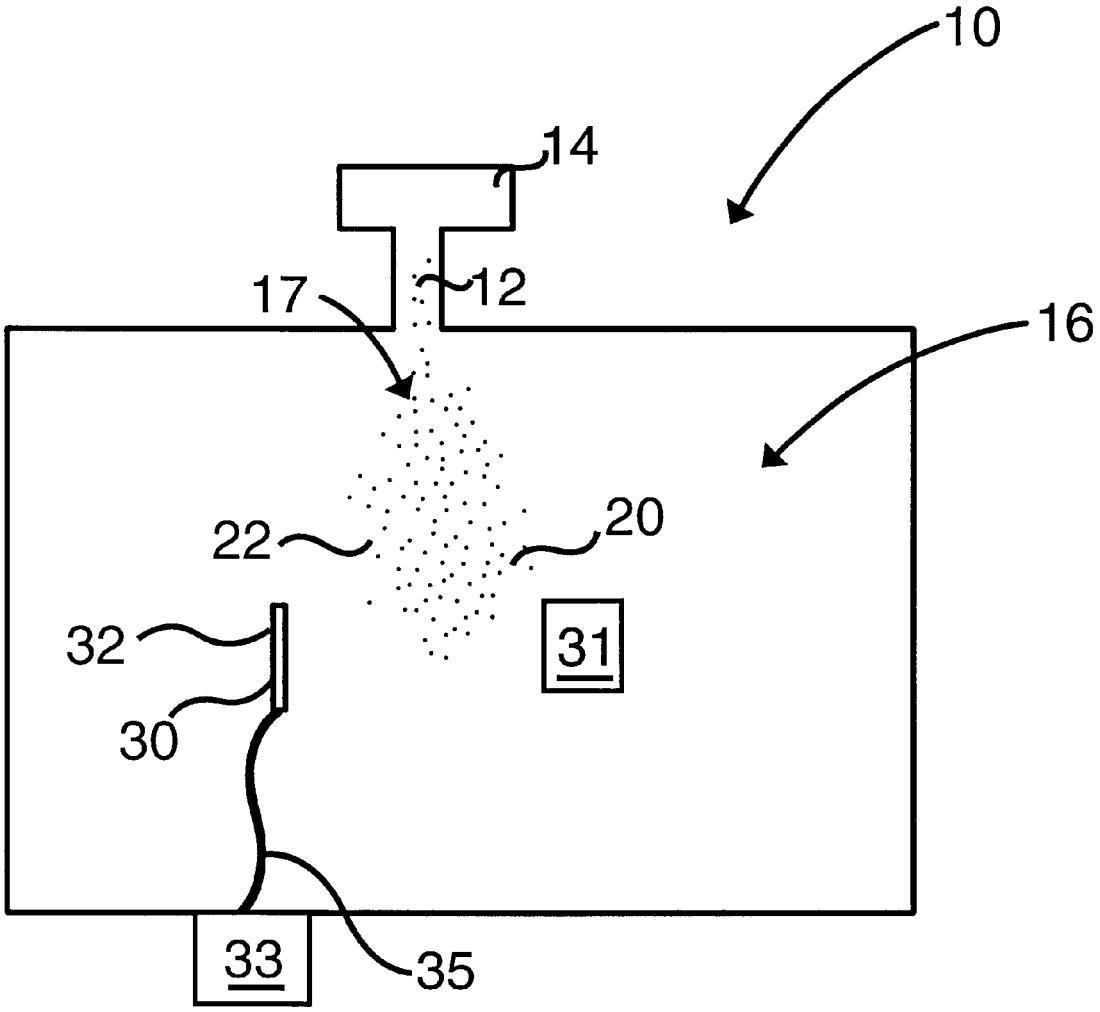
FIG. 1 shows a method and apparatus for shielding an exposed surface from harmful airborne agents by electrification of the surface.

Now referring to FIG. 1, there is shown a method and apparatus for shielding an exposed surface contained in an enclosed space from harmful airborne biological and chemical agents by electrification of the exposed surface. The apparatus is an airborne agent deflector generally indicate by the numeral 10. The deflector 10 is particularly useful for shielding exposed surfaces that are conductive in nature, such as metals, semiconductors and humans or parts thereof from harmful airborne agents in the form of aerosols or droplets.

The deflector 10 operates as follows: A plurality of charged particles 12, from a charged particle source 14, is passed into or generated in an enclosed space generally indicated by the numeral 16 for forming a charged particle cloud generally indicated by the numeral 17 therein. Charged particles 12 can be in the form of (1) charged particulates, droplets or clusters; (2) ions, either molecular or atomic; or (3) electrons. In the preferred form of the invention, charged particles 12 are ions or are electrons that attach to molecules and form ions. The charge particle source 14 can be an ionizer or spray device for producing charged particles in the form of electrons, ions, charged particulates, charged droplets or charged clusters. In the preferred form of the invention, the charge particle source 14 is a source of ions or are electrons that from ions upon attachment to molecules. Suitable sources of ions include radioactive sources, such as polonium ionizers, surface ion sources and discharge sources such as corona devices. In the preferred form of the invention, source 14 is a conventional negative ion source well known in the art and used for creating a negatively charged atmosphere in enclosed spaces such as a building. Suitable sources are disclosed in U.S. Pat. Nos. 4,672,504 and 4,366,525 and references contained therein. An example of a charged particle source suitable for the generation of a charged cloud of particles in enclosed spaces such as vehicles, which can be used in accordance with the present teachings, is given in U.S. Pat. No. 4,911,737.

After or during the creation of cloud 17 in space 16, the charged particles 12 combine with, transfer their charge or otherwise electrify one or more airborne agents 20 in enclosed space 16 for both (1) placing a charge of a single polarity type on agents 20 for forming one or more charged airborne agents 22 capable of being electrostatically manipulated; and (2) maintaining the charge of a single polarity type on agents 22. Charged particles 12 maintain the charge of a single polarity type on charged agents 22 by neutralizing unwanted charges that may be present in space 16.

In one form of the invention, charged particles 12 can be passed into or generated in enclosed space 16 for forming cloud 17 throughout the volume of enclosed space 16 for charging airborne agents 20 contained therein. In another form of the invention, charged particles 12 can be passed into or generated at or near an airborne agent source 31 where harmful airborne agents 20 are being produced for charging agents 20 before they spread throughout space 16. Airborne agent source 31 can be a medical tool or a biological organism. In the preferred form of the invention, the charged particles are passed into enclosed space 16 from the top of the enclosure as shown in FIG. 1 above where harmful airborne agents 20 are being produced for combining with and forming charged airborne agents 22.

After airborne agents 20 have been electrified into one or more charged airborne agents 22, an electrostatic charge is supplied to or otherwise created on an exposed surface 30 on an object for repelling or deflecting charged agents 22 from surface 30. In one form of the present invention, airborne agents 20, that would due to their trajectories otherwise come into contact with the exposed surface, are shielded in such a manner that they do not deposit on the exposed surface. In those cases where surface 30 on object 32 is of a conductive nature, the electrostatic charge can be applied by a Van de Graff generator 33 or other electrostatic generator well known in the art. The electrostatic charge is supplied to object 32 through a cable 35. In order to maintain the electrostatic charge it is also necessary to properly insulate the object 32 from ground so that the electrostatic charge will not bleed off In those cases wherein object 32 is a human body or a part thereof an electrostatic generator of the type described in U.S. Pat. Nos. 5,906,638 and 4,802,470 and references contained therein can be used. In those cases wherein surface 30 is in the form of a wound, ulcer or burn on a human body the electrode used to attach the electrostatic generator to the wound can be of the type described in U.S. Pat. No. 5,218,973 and references contained therein.

In another form of the invention, charged particles 12 are passed into or are generated in enclosed space 16 near the surface to be protected.

In still another form of the invention, charged particle source 14 is of a type well known in the art, an example being U.S. Pat. No. 4,854,500, that produces charged particles 12 in the form of charged droplets or clusters for absorbing, dissolving or otherwise combining with airborne agents 20 that are in the form of a gas such as a toxic gas. The charged droplets or clusters can be of an acidic nature for reacting with or otherwise combining with alkaline airborne agents or the charged droplets or clusters can be of an alkaline nature for reacting with or otherwise combining with acidic airborne agents.

The air contained in enclosed space 16 can be in the form of filtered air for reducing the amount of airborne agents contained in enclosed space 16.

In another form of the invention, a semiconductor surface is protected from airborne agents. In this form of the invention, instead of electrifying exposed surface 30 a semiconductor surface is protected by an electrified object. The electrified object can be the semiconductor surface or an object near the surface for moving airborne agents away from the semiconductor surface. This method for protecting a semiconductor surface from airborne agents, comprises the steps of: maintaining an electrical charge on the airborne agents for forming a plurality of charged airborne agents; maintaining an electrical charged on an object for moving said charged airborne agents away from the semiconductor surface without the use of air moving devices for protecting the semiconductor surface. The object can be the semiconductor surface or an object near to it. This method of protecting a semiconductor surface allows for the processing of semiconductor materials with the deposition of airborne agents.

Figure 2:
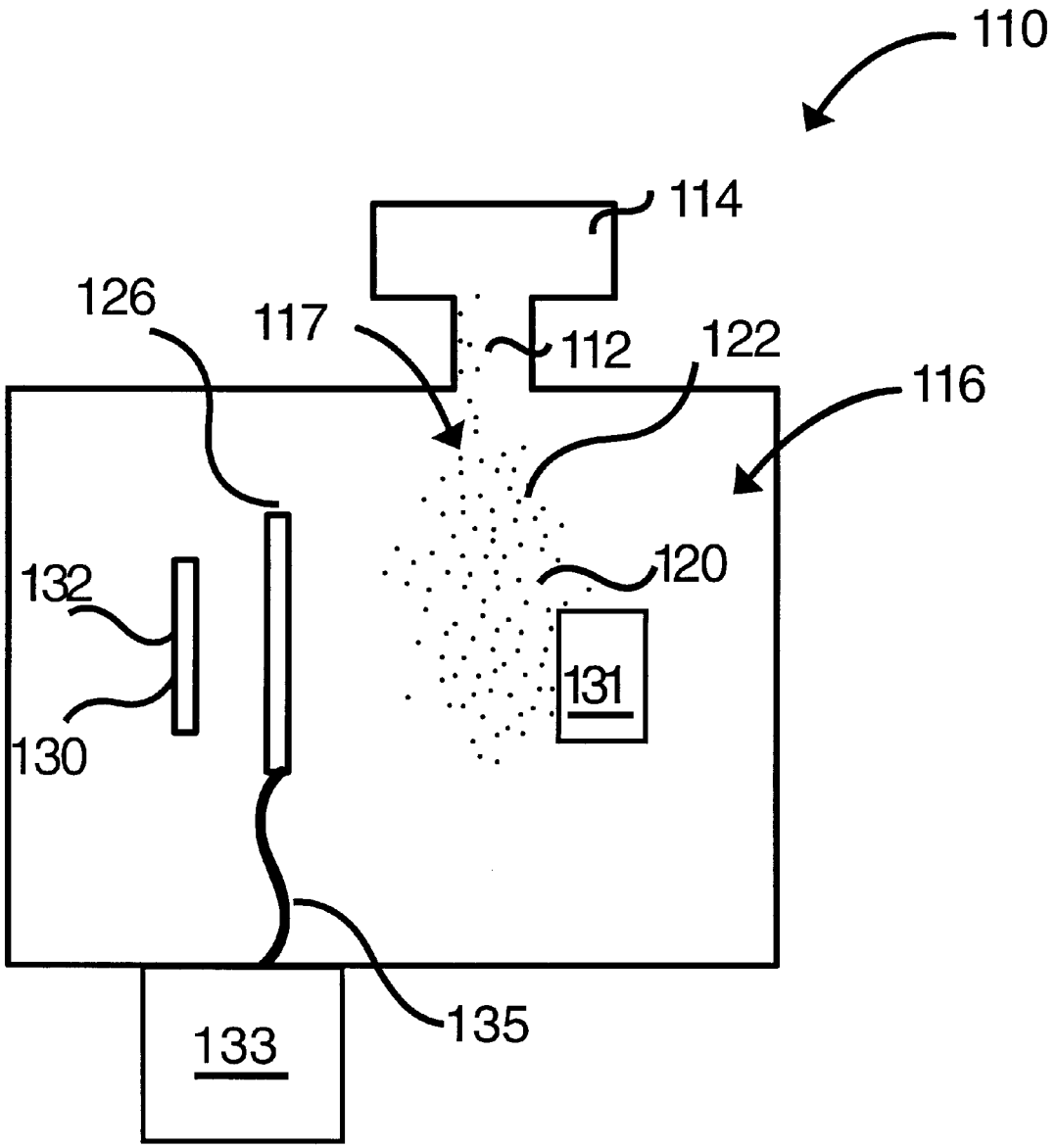
FIG. 2 shows a method and apparatus for shielding an exposed surface from harmful airborne agents by electrification of an object near the exposed surface.

Now referring to FIG. 2 there is shown a method and apparatus for shielding an exposed surface by electrification of an object near the exposed surface for repelling harmful airborne agents from the exposed surface. The apparatus is an airborne agent deflector gererally indicated by the numeral 110.

The airborne agent deflector 110 operates as follows. A plurality of charged particles 112, from a charged particle source 114, is passed into or generated in an enclosed space generally indicated by the numeral 116 for forming a charged particle cloud generally indicated by the numeral 117 therein.

After or during the creation of cloud 117 in space 116, the charge particles 112 combine with, transfer their charge or otherwise electrify one or more airborne agents 120 in enclosed space 116.

After airborne agents 120 have been electrified into one or more charged airborne agents 122, an electrostatic charge is supplied to or otherwise created on a object 126 for repelling airborne agents 122 from a surface 130 to be shielded in enclosed space 116. The electrostatic charge on object 126 repels or deflects charged agents 122 from surface 130 for shielding surface 130. Object 126 can be of a conductive nature or an insulator. In the preferred form of the invention, object 126 is in the form of a conductor and the electrostatic charge can be applied to object 126 by a Van de Graff generator or the like.

In one form of the invention, object 126 can be a bandage or part thereof for deflecting airborne agents 122 from a wound. A flow of air may then be applied to the bandage/wound for exposing the wound to air having a high oxygen content for accelerating the rate of healing.

In still another form of the invention, object 126 is an air filter comprised of a non-entraining filter material having openings for filtering particles 15 microns in diameter or greater in diameter.

Figure 3:
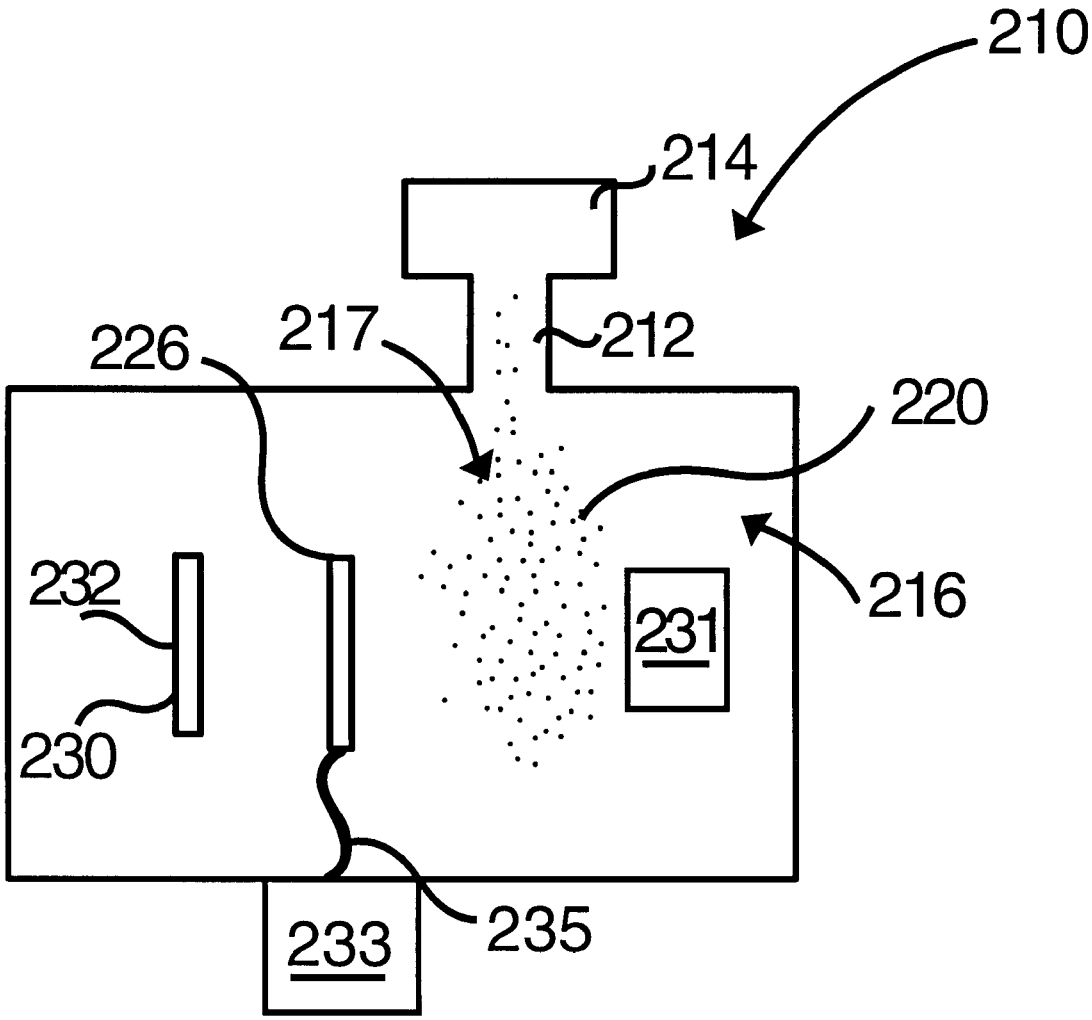
FIG. 3 shows a method and apparatus for shielding an exposed surface by electrification of an object near the exposed surface for attracting harmful airborne agents from the exposed surface.

Now referring to FIG. 3 there is shown a method and apparatus for shielding an exposed surface by electrification of an object near the exposed surface for attracting harmful airborne agents from the exposed surface. The apparatus is an airborne agent attractor gererally indicated by the numeral 210.

The airborne agent attractor 210 operates as follows. A plurality of charged particles 212, from a charged particle source 214, is passed into or generated in an enclosed space generally indicated by the numeral 216 for forming a charged particle cloud 217 therein.

After or during the creation of cloud 217 in space 216, the charge particles 212 combine with, transfer their charge or otherwise electrify one or more airborne agents 220 in enclosed space 216 for forming charged airborne agents 222.

After airborne agents 220 have been electrified into charged agents 222, an electrostatic charge is supplied to or otherwise created on a object 226 for attracting airborne agents 222 from a surface 230 to be protected in enclosed space 216. The electrostatic charge on object 226 attracts charged agents 222 from an area near surface 230 for protecting surface 230. Object 226 can be of a conductive nature or an insulator. In the preferred form of the invention, object 226 is in the form of a conductor and the electrostatic charge is be applied by a Van de Graff generator or the like.

In another form of the invention, object 226 is a part of a surgical garment for attracting airborne agents away from the face and head region of the wearer.

In still another form of the invention, object 226 is located near or on a vacuum device for directing charged particles into the vacuum device.

Figure 4:
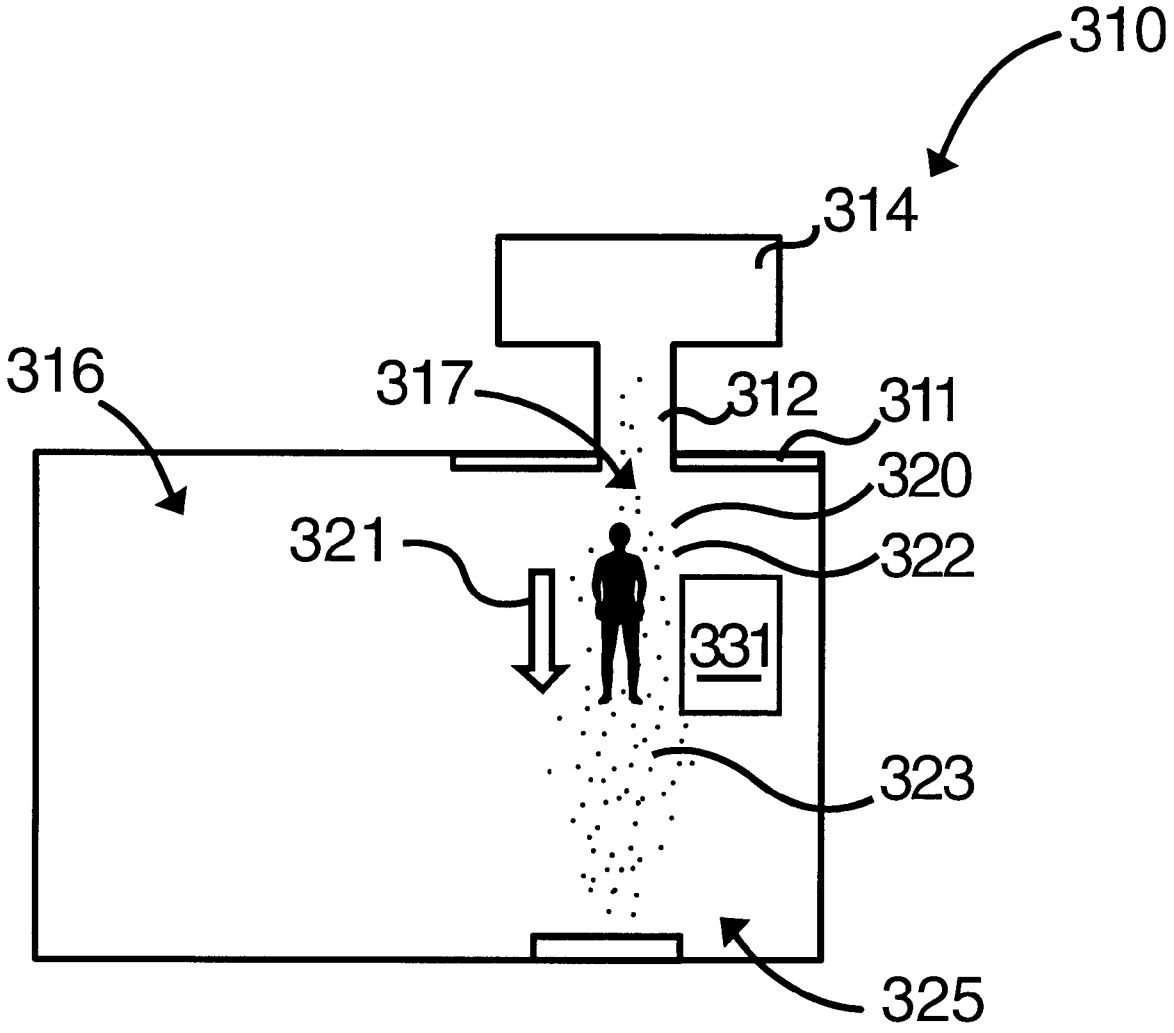
FIG. 4 shows a method and apparatus for protecting an exposed surface by passing charging particles through a volume containing one or more exposed surfaces for collecting and removing airborne agent.

Now referring to FIG. 4 there is shown a method and apparatus for protecting an exposed surface by use of an electrostatic field for passing charging particles through a volume containing one or more exposed surfaces for collecting and removing airborne agent. The apparatus is an airborne agent remover generally indicated by the numeral 310.

The airborne agent remover 310 operates as follows. A plurality of charged particles 312, from a charged particle source 314, is passed into or generated in an enclosed space generally indicated by the numeral 316 for forming a charged particle cloud 317 therein. Enclosed space 316 contains one or more exposed surfaces 399. An electrostatic field, generated by one or more electrodes 311 of the type used to move charged particles through a large volume and having a general direction as indicated by an arrow 321 is applied to charged particle cloud 317 for moving charged particles 312 though a volume of space generally indicated by the numeral 323.

During the movement of charge particles 312 through space 323, the charge particles 312 combine with, transfer their charge or otherwise electrify one or more airborne agents 320 in space 323 for forming charged airborne agents 322. The charged airborne agents 322 are also directed by the electrostatic field to move in the direction indicated by arrow 323. In the preferred form of the invention, the airborne agents 322 are directed towards the floor for protecting exposed surfaces 399 which can be a face or head or an individual as shown. A vacuum 325 located on the floor can be used to collect and remove the electrified agents 322. In another form of the invention, an electrode located on the floor is used to collect and remove electrified agents 322.

Figure 5:
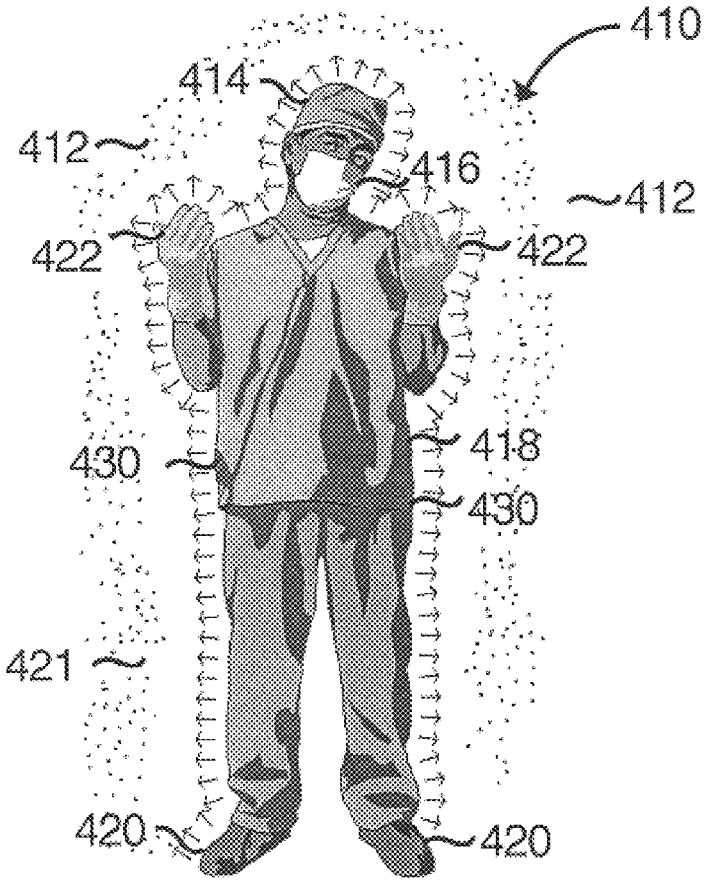
FIG. 5 shows a method and apparatus for protecting the exposed surfaces of a medical practitioner.

Now referring to FIG. 5 there is shown a method and apparatus for protecting the exposed surfaces of a medical practitioner from harmful airborne agents. The apparatus is a protective shield generally indicated by the numeral 410.

The protective shield 410 operates as follows. An electrical charge of single polarity is placed on and maintained on a plurality of airborne agents 412. An electrostatic charge of the same polarity as agents 412 is placed on and maintained on the following, (1) a scrub cap 414, (2) a mask 416, (3) a gown 418, (4) a plurality of shoe coverings 420, and (5) a plurality of gloves 422 for repelling agents 412. In addition, the body of the medical practitioner is given an electrostatic charge of the same polarity as the items listed above for repelling airborne agents 412. The electrostatic charge on the cap 414, mask 416, gown 418, shoe coverings 420, gloves 422 and the human body provide for a repellant shield generally indicated by the numeral 430 and shown by arrows showing the direction of the electrostatic force applied to agents 412 for shielding the medical practitioner from pathogenic aerosols.

Figure 6:
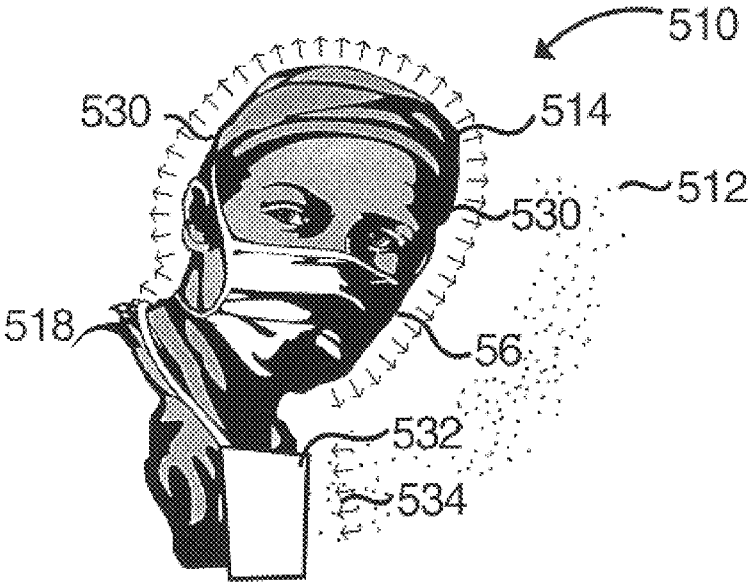
FIG. 6 shows another embodiment of the invention for protecting the exposed surfaces of a medical practitioner.

Now referring to FIG. 6, there is shown another embodiment of the invention for protecting the exposed surfaces of a medical practitioner. The apparatus is a protective shield/collector generally indicated by the numeral 510. The shield/collector 510 is useful for shielding an exposed surface such as a medical practitioner and collecting airborne agents for disposal. The shield/collector 510 is particularly useful in shielding dental practitioners, such as and their staff from airborne agents and the collection of aerosols produced during cleaning, drilling, sanding and the like.

The protective shield/collector 510 operates as follows. An electrical charge of single polarity is placed on and maintained on a plurality of airborne agents 512. The airborne agents 512 can be produced by the cleaning, drilling and sanding of teeth. An electrostatic charge of the same polarity as agents 512 is placed on and maintained on the following; (1) a scrub cap 514, (2) a mask 516 and (3) a gown 518, (4) In addition, the body of the medical practitioner is given an electrostatic charge of the same polarity as the items listed above for repelling airborne agents 512. The electrostatic charge on the cap 514, mask 516, and gown 518 and the human body provide for a repellant shield generally indicated by the numeral 530 and shown by arrows showing the direction of the electrostatic force applied to agents 512 for shielding the medical practitioner from pathogenic aerosols. A collection surface 532 is placed on the front of the medical practitioner for collecting airborne agents 512. Collection surface 532 has an electrostatic charged applied to it that is in opposite polarity to that placed on the airborne agents 512 for attracting airborne agents 512. The electrostatic charge on collection surface 532 provides for an electrical field generally indicated by the numeral 534 and shown by arrows. In the preferred form of the invention, the collection surface 532 is in the form of a disposal material. In order to protect patients airborne agents 512 that are collected on surface 532 surface 532 is replaced after the treatment of a patient and before treating the next.

Figure 7:
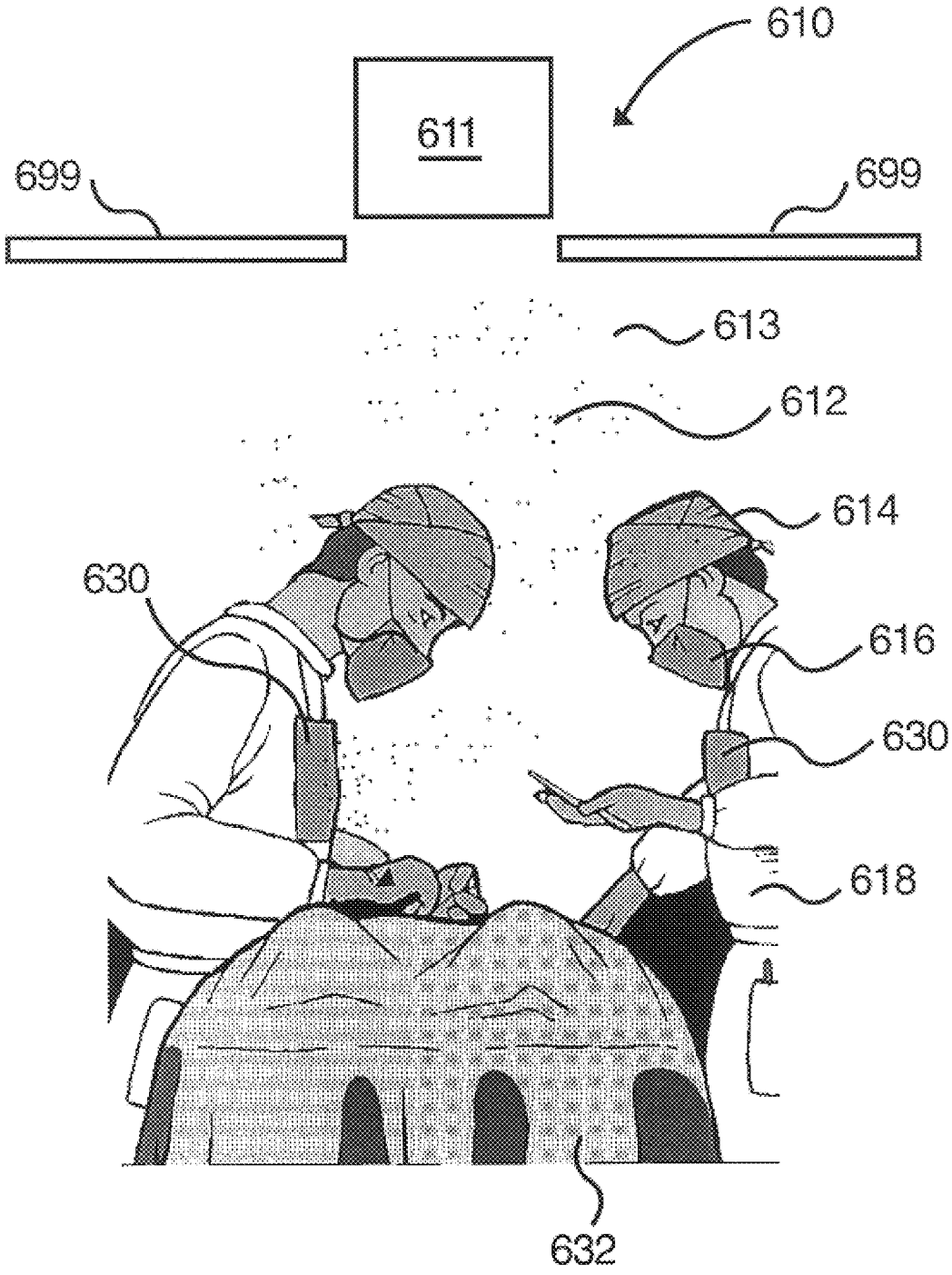
FIG. 7 shows a method and apparatus for protecting the medical staff and patient from airborne agents during an operation.

Now referring to FIG. 7 there is shown a method and apparatus for protecting the medical staff and patient from airborne agents during an operation. The apparatus is a protective operating room shielding system generally indicated by the numeral 610. The shielding system 610 is useful for shielding the exposed surfaces of both the medical staff and the patient. The shielding system 610 is particularly useful in shielding medical practitioners from aerosols produced by patients and for shielding patients with reduced immune responses to airborne agents during medical operations.

The shielding system 610 operates as follows. An ionizer 611 produces a charged cloud 613 of charged species of a single polarity for electrifying one or more airborne agents 612 produced during the operation. An electrical field generally indicated by arrow 615 directs the charged species 613 toward the operating environment. The electrical field is generated by one or more electrodes 699. The charged species in cloud 613 combine, transfer their charge to or otherwise electrify a plurality of airborne agents 612 with a charge of single polarity. The airborne agents 612 can be produced unintentionally from the use of medical equipment such as saws, drills and the like. An electrostatic charge of the same polarity as agents 612 is placed on and maintained on the following; (1) one or more scrub caps 614, (2) one or more masks 616, (3) one or more gowns 618, (4) one or more shoe coverings 620, (5) gloves 622 and the human bodies and parts thereof including wounds provide for a repellant shield generally indicated by the numeral 630 and shown by arrows showing the direction of the electrostatic force applied to agents 612 for shielding the medical practitioner and the patient from pathogenic aerosols. A collection surface 630 is placed on the front of each medical practitioner for collecting airborne agents 612 as shown. Collection surface 530 has an electrostatic charged applied to it that is in opposite polarity to that placed on the airborne agents 612 for attracting airborne agents 612. In addition, one or more drapes 632 have a charge applied to them for attracting charged airborne agents to them.

Figure 8:
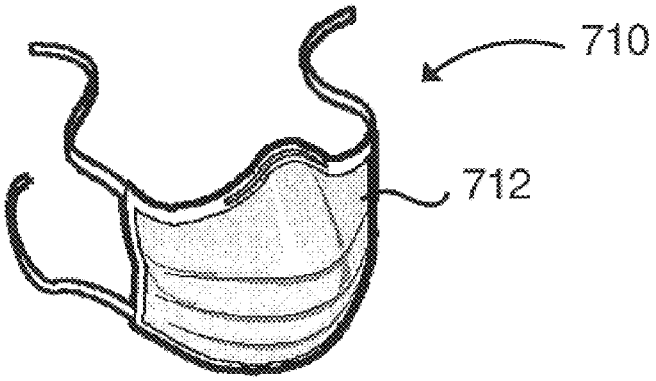
FIG. 8 shows a method and apparatus for applying an electrostatic charge to a face mask for repelling charged airborne agents.

Now referring to FIG. 8 there is shown a method and apparatus for applying an electrostatic charge to a face mask for repelling charged airborne agents. The apparatus is a charged mask generally indicated by the numeral 710.

The mask 710 is comprised of one or more electrostatically-charged polymers fiber layers 712 to repel charged airborne agents. The repelling material can be of a type manufactured by 3M Corporation (USA) under the trade name filterette, or as manufactured by Hepworth.

Figure 9:
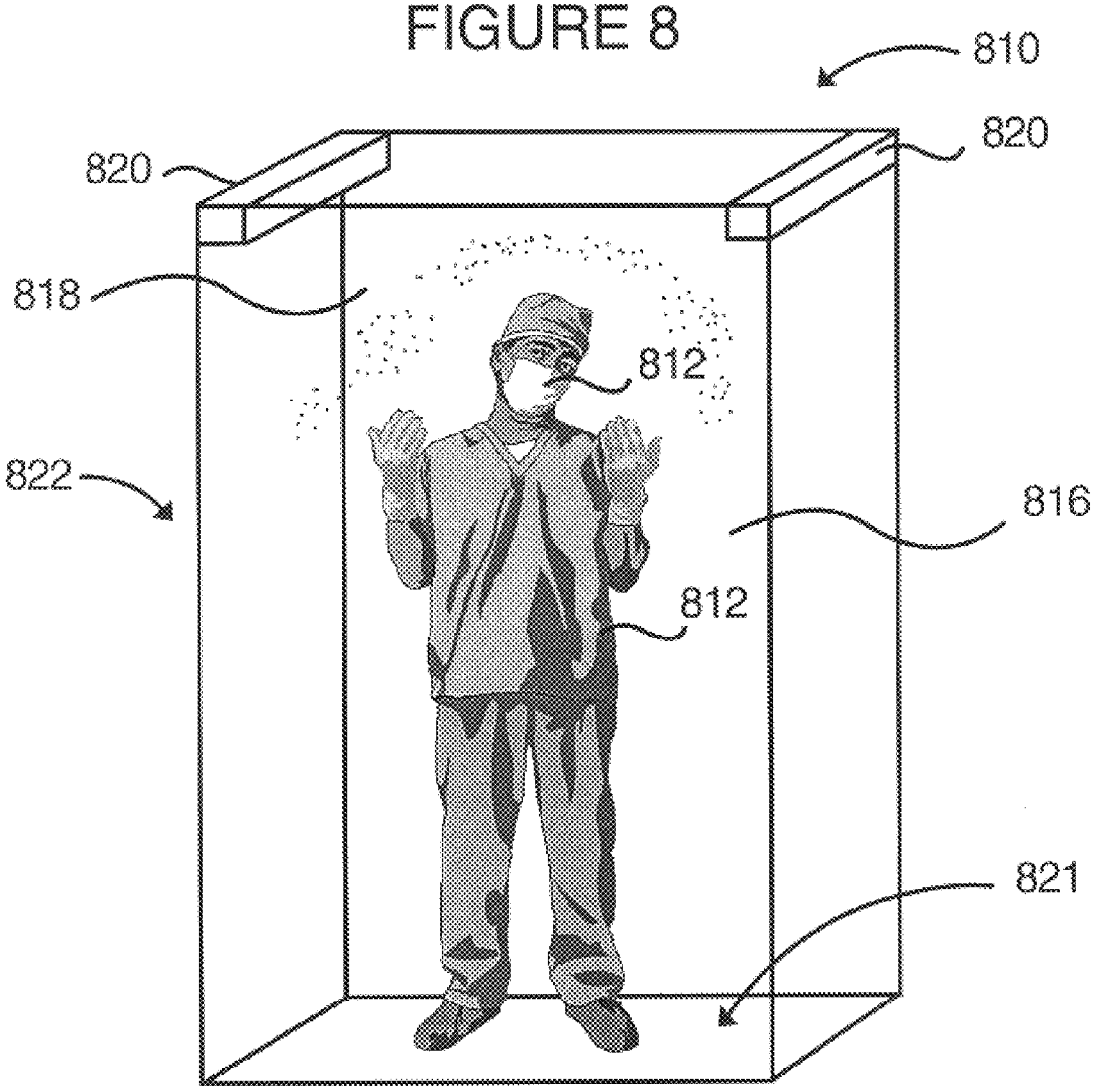
FIG. 9 shows a method and apparatus for applying an electrostatic charge to items and individuals for repelling charged airborne agents.

Now referring to FIG. 9 there is shown a method and apparatus for applying an electrostatic charge to exposed surfaces such as individuals and their clothing. The apparatus is a spray charger generally indicated by the numeral 810. The charger 810 is useful for electrifying exposed surfaces of animate and inanimate objects. The charger is particularly useful in electrifying nonconductive objects such as material made of cotton, synthetic material, glass and the like.

The spray charger 810 operates as follows. First, an object 812 having one or more exposed surfaces 814, for example a clothed person, is placed in a room or booth 816. The booth 816 has an electrically insulating floor 821. Object 812 and exposed surfaces 814 thereon are then sprayed with a plurality of charged droplets or aerosol 818 with an electrostatic spray device 820 of a type well known in the art. Charged droplets 818 are of single polarity for charging the exposed surfaces with a single polarity. The droplets 818 can contain a disinfectant for disinfecting exposed surfaces 814. After charging, object or individual 812 is removed or exits the booth 816 and enters into a region of space generally indicated by the numeral 822. Region 822 is of a higher pressure then the pressure in enclosed space 816. Region 822 can be an enclosed space containing charged airborne agents having the same polarity as object 812.

Figure 10:
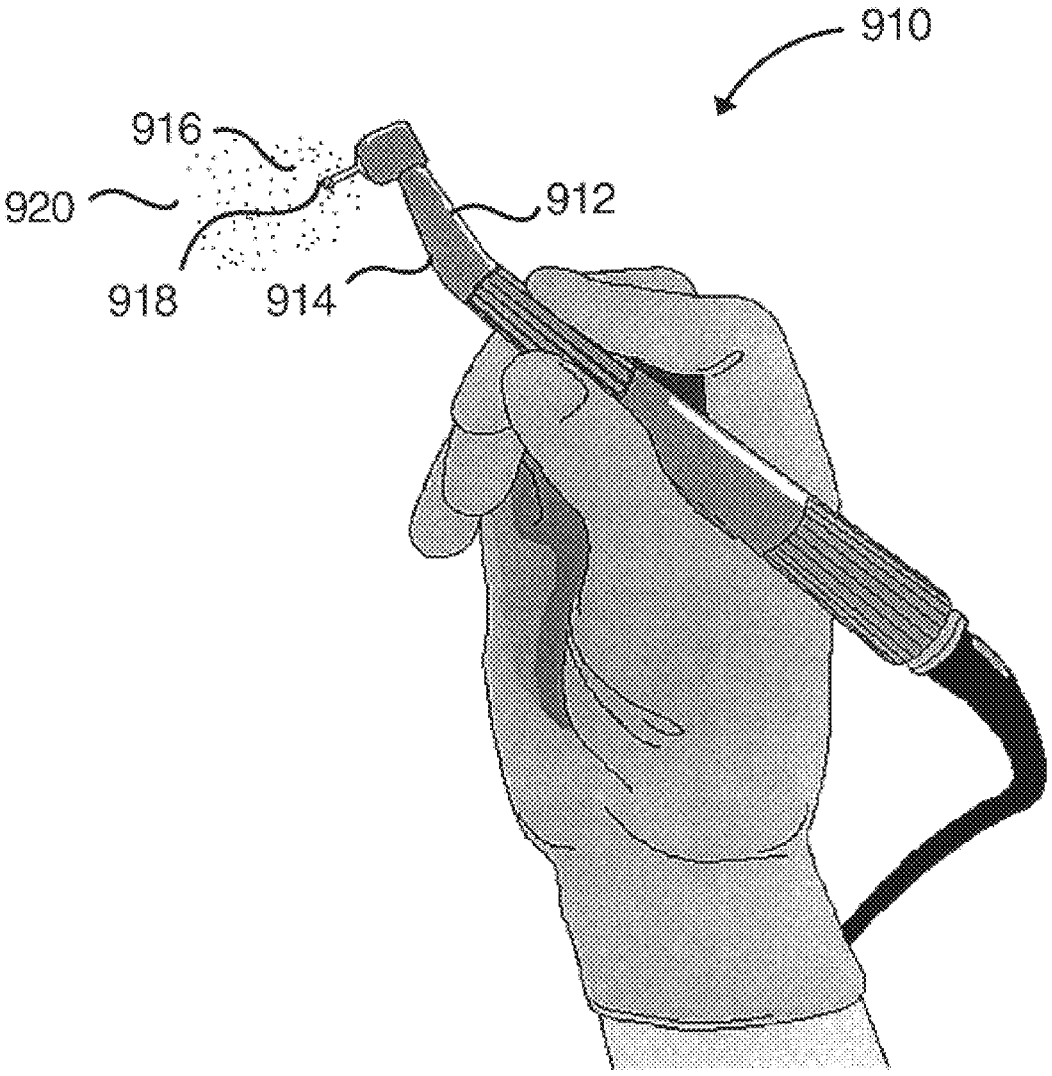
FIG. 10 shows a method and apparatus for electrostatically charging aerosols produced by a medical tool.

Now referring to FIG. 10 there is shown a method and apparatus for electrostatically charging aerosols produced by a medical tool such as a drill saw, reamer and other aerosol producing tools. The apparatus is an aerosol ionizer generally indicated by the numeral 910. The aerosol ionizer 910 is useful for charging aerosols produced by medical tools, in particular, electric medical tools such as drill, saws, reamers and other tissue removing devices.

The aerosol ionizer 910 is comprised of a medical tool 912, for example a drill as shown, and a ionizer 914. In the preferred form of the invention, the drill and ionizer are attached to each other. In particular, the ionizer forms an charging cloud 916 of ions in the close to the tissue removing edge of the medical tool, in the case of a drill, close to a drill bit 918.

In operation of the aerosol ionizer 910 the ionizer is actuated when the drill is turned on and in use. The charging cloud 916 of ions attaches to one or more aerosol particles 920 for charging the aerosol particles. The charged aerosol particles 920 are electrostatically manipulated in such a manner, as described in the present invention, as to not alight upon the medical practitioner (see FIG. 6 of the present invention).

In another form of the invention, the drill itself is charged to act as a charger.

It should be recognized by those skilled in the art, that the patient, medical practitioner and drill are to be charged to the same potential for comfort and safety.

Figure 11:
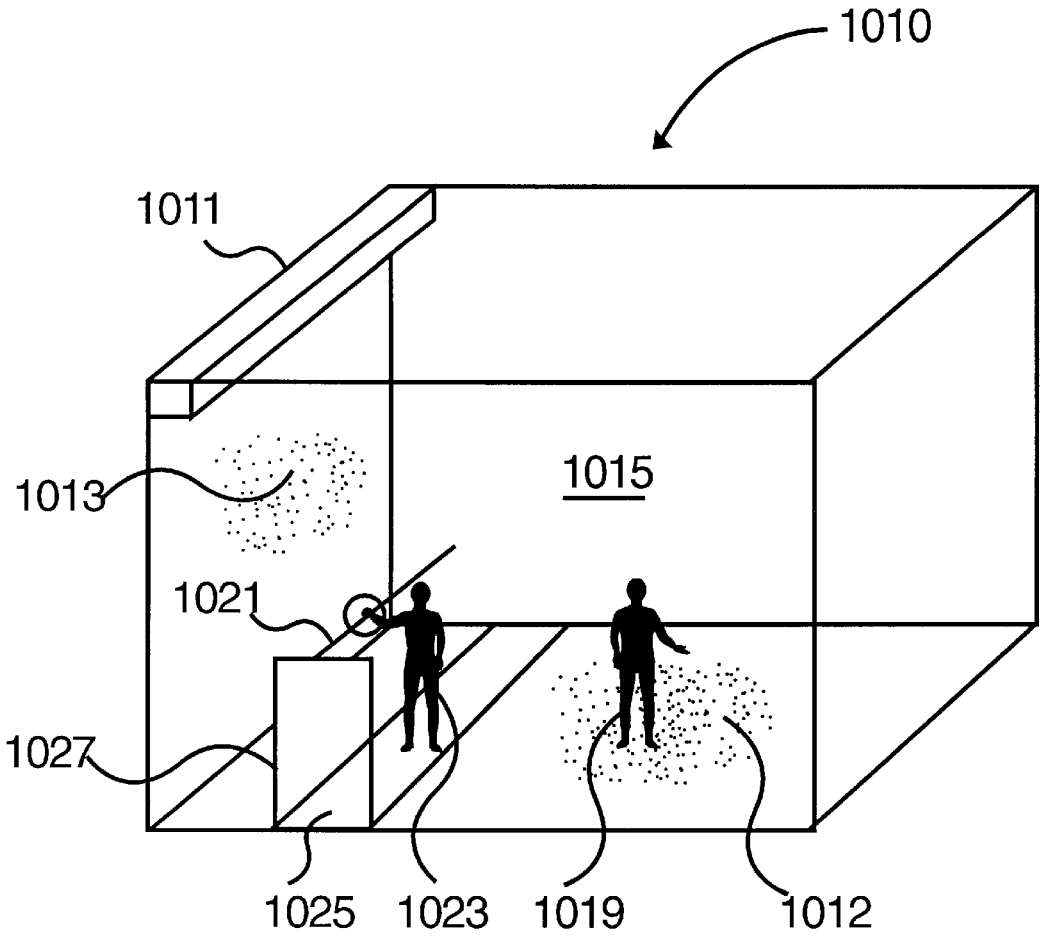
FIG. 11 shows a method and apparatus for charging one or more individuals for repelling toxic or pathogenic aerosols produced by, for example, of a terrorist attack in a public building.

Now referring to FIG. 11 there is shown a method and apparatus for charging one or more individuals for repelling toxic or pathogenic aerosols produced by, for example, a terrorist attack in a public building. The apparatus is aerosol repellant generally indicated by the numeral 1010. The aerosol repellant 1010 is useful for repelling harmful airborne agents from one or more persons in an enclosed public building such as but not limited to, an airport, a train station, a school or university or other place of learning, or a place of worship.

The aerosol repellant 1010 operates as follows. An ionizer 1011 produces a plurality of charged species 1013 of a single polarity for combining with aerosols produced in the terrorist attack. In the preferred form of the invention, charged species 1013 are electrons and the ionizer 1011 is a source of electrons and is of the type well known in the art. The ionizer 1011 operates continuously while the public building is occupied for filling one or more enclosed spaces 1015 in the building with charged species 1013. After or during the dissemination of a plurality of airborne agents 1012 by one or more terrorists 1019, the charged species 1013 combine, transfer their charge to or otherwise electrify airborne agents 1012 with a charge of single polarity. An electrostatic charge of the same polarity as charged agents 1012 is placed on and maintained on one or more cables 1021 in enclosed spaces 1015. Cable 1021 is a source of high voltage of between 20,000 to 50,000 volts and low current 1 to 5 microamperes for electrifying one or more intended victims 1023 of the attack. The high volt cable 1021 is located above an insulating floor 1025 for protecting the intended victims 1023 from being shocked. In the preferred form of the invention, the cable 1021 leads to an exit 1027. Before, after, or during the terrorist attack, the intended victims 1023 are warned by an electrically produced signal such as a light, bell or horn to hold onto cable 1021 for placing an electrostatic charge on the intended victims for repelling charged airborne agents 1012 from their bodies. They are also instructed to place a wet or damp cloth over their mouth and nose for repelling airborne agents 1012 and to protect their lungs. The intended victims are then instructed to continue to hold onto cable 1021 and at the same time exit the enclosed space 1015 through exit 1027. The intended victims 1023 exit in a more orderly manner than without such a cable present.

Figure 12:
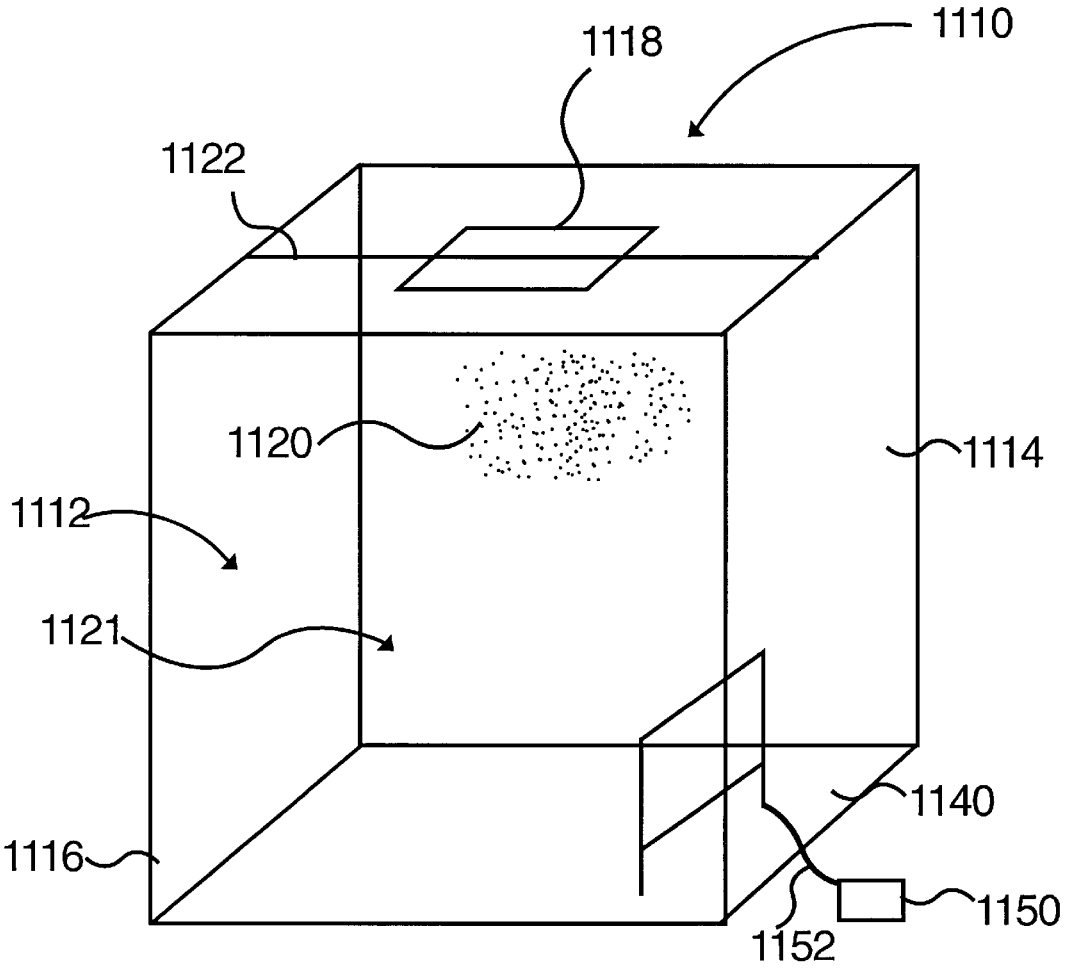
FIG. 12 shows a method and apparatus for confining and collecting harmful airborne agents produced in a medical procedure or by a patient.

Now referring to FIG. 12 there is shown a method and apparatus for confining and collecting harmful airborne agents produced by a patient or a medical procedure. The apparatus is an aerosol charger/collector generally indicated by the numeral 1110. The apparatus is a self-contained, portable and prefabricated apparatus adapted to be assembled within the confines of a preexisting structure or room such as a hospital room, operating room, or medical or dental consultation room for confining and collecting airborne agents.

The charger/collector 1110 operates as follows. A region of space generally indicated by the numeral 1112 is which pathogenic airborne agents may be produced is enclosed by a walling material 1114 for forming an enclosed space 1112. Space 1112 can be part of a hospital room or part of a medical or dental examination room. The pathogenic airborne agents can be produced by the following: (1) the removal of human tissues; (2) the contacting of a medical tool with bodily fluids; and (3) by a patient. Walling material 1114 can be made of plastic, rubber, and the like. The walling material 1114 can be supported by a supporting material 1116. Supporting material 1116 can be stainless steal. Enclosed space 1112 can have a floor 1140 made of insulating material.

A charging device 1118, such as an ionizer, produces a cloud 1120 of charged species. One or more electrodes 1122 are situated above the enclosed space 1112 for providing an electrical field for moving charged species 1120 downward toward a region generally indicated by the numeral 1121 where a plurality of potential harmful airborne agents 1124 are being produced. An electrostatic charge can be placed on walling material 1114 for repelling charged species 1120.

As cloud 1120 of charged species is moved through region 1121 the charged species combine with, transfer their charge to, or otherwise electrify agents 1124 for forming a plurality of charged airborne agents 1126. Charged airborne agents are collected by one or more charged collection surfaces 1130. Collection surfaces 1130 can be d charged by a power source 1150 through cable 1152.

A UV light source 1170 can be used to illuminate collection surfaces 1130 for destroying or killing pathogens. In the preferred mode of the invention the UV light source 1170 is a ultraviolet sterilizer lamp are fluorescent lamps that emit radiation at about 254 nm, which is suitable for killing all microorganisms on small particles, i.e., 10 microns or less.

In another form of the invention, a vacuum system 1160 is provided for producing a flow of air that moves cloud 1120 downward and through region 1121.

One or more exposed surfaces contained in space 1112 can be charged for repelling airborne agents 1124.

I claim:

1. A method for protecting a disease transmitting surface from infectious airborne agents, said method comprising the steps of:

a. generating a plurality of charged particles in a charged particle source for producing an electrostatically-charged cloud and charging said infectious airborne agents by exposure to said electrostatically-charged cloud for forming a plurality of charged infectious airborne agents; and b. electrostatically manipulating said infectious agents away from said disease transmitting surface for protecting said surface from said infectious agents.

2. A method according to claim 1, further comprising the step of manipulating said charged infectious airborne agents away from said surface by electrostatic repulsion.

3. A method according to claim 1, further comprising the step of manipulating said charged infectious airborne agents away from said disease transmitting surface by electrostatic attraction.

4. A method according to claim 1, further comprising the step of passing a plurality of charged particles above where infectious airborne agents are being produced for forming said charged infectious airborne agents.

5. A method according to claim 1, further comprising the step of passing a plurality of charged droplets above where infectious airborne agents are being produced for forming said charged infectious airborne agents.

6. A method according to claim 1, further comprising the step of placing an electrostatic charge on a surgical garment for electrostatically manipulating said infectious airborne agents away from said disease transmitting surface.

7. A method according to claim 6, wherein said surgical garment is comprised of one or more electrostatically charged polymer fibers.

8. A method according to claim 6, wherein said surgical garments is from the group consisting of a scrub cap, a mask, a gown, a plurality of shoe coverings, and a plurality of gloves.

9. A method according to claim 1, further comprising collecting said charged infectious airborne agents on a collection surface.

10. A method according to claim 9, further comprising the step charging said collection surface for collecting said charged infectious airborne agents.

11. A method according to claim 1 further comprising the step of placing a collection surface on the front of a medical practitioner for collecting said charged infectious airborne agents.

12. A method according to claim 1, further comprising the step of placing an electrostatic charge on a medical practitioner for repelling said charged infectious airborne agents away from said practitioner.

13. A method according to claim 1, further comprising the step of directing charged particles toward an operating environment for electrifying infectious airborne agents produced by a medical device.

14. A method according to claim 1, including the step of attaching an ionizer to a medical tool for charging aerosol particles for forming charged aerosol particles and electrostatically manipulating said charged particles away from a medical practitioner.

15. A method according to claim 1, further comprising the step of placing an electrostatic charge on a surgical drape for electrostatically manipulating said charged infectious airborne agents away from said disease transmitting surface.

16. A method according to claim 1, further comprising the step of directing said charged infectious airborne agents towards a vacuum.

* * * * *